United States Patent [19]

Carter

[11] 4,242,567

[45] Dec. 30, 1980

[54] ELECTRICALLY HEATED HAIR STRAIGHTENER AND PTC HEATER ASSEMBLY THEREFOR

[75] Inventor: Robert A. Carter, Asheboro, N.C.

[73] Assignee: General Electric Company, New York, N.Y.

[21] Appl. No.: 912,370

[22] Filed: Jun. 5, 1978

[51] Int. Cl.[3] ..... A45D 1/02; H05B 3/12; H01C 1/148

[52] U.S. Cl. ..... 219/225; 132/31 R; 132/32 R; 132/37 R; 219/230; 219/241; 219/505; 219/539; 219/541; 338/22 R; 338/295; 338/314; 338/328

[58] Field of Search ..... 219/222–225, 219/504, 505, 539, 541, 241, 230, 533; 338/328, 314, 22 R, 23, 28, 204, 205, 295; 132/31, 32, 37

[56] References Cited

U.S. PATENT DOCUMENTS

| | | | |
|---|---|---|---|
| 1,422,826 | 7/1922 | Brown | 219/225 X |
| 2,606,986 | 8/1952 | Sweger | 338/23 X |
| 2,621,280 | 12/1952 | Judd | 219/225 |
| 3,375,774 | 4/1968 | Fujimura et al. | 219/505 X |
| 3,689,736 | 9/1972 | Meyer | 219/505 |
| 3,720,807 | 3/1973 | Ting | 219/505 X |
| 3,794,949 | 2/1974 | Larsen et al. | 338/22 R |
| 3,885,129 | 5/1975 | Fabricius | 219/504 X |
| 3,976,854 | 8/1976 | Ishikawa et al. | 219/505 |
| 3,995,141 | 11/1976 | Vieau et al. | 219/505 X |
| 3,996,447 | 12/1976 | Bouffard et al. | 219/505 X |
| 4,147,927 | 4/1979 | Pirotte | 219/539 |

FOREIGN PATENT DOCUMENTS 2504237 8/1975 Fed. Rep. of Germany ..... 219/225

*Primary Examiner*—A. Bartis

*Attorney, Agent, or Firm*—John F. Cullen; George R. Powers; Leonard J. Platt

[57] ABSTRACT

A heated hair straightener has a handle connecting to an electric source and a pair of scissor-like clamp housings pivoted on the handle and having facing coverplate surfaces for clamping and straightening the hair. This combination has an improvement in the heater sub-assembly fitting in one of the housings and formed as a sandwich arrangement including an aluminum coverplate, a copper elongated heater plate forming a first electrode connected to one side of the line and electrically insulated from the coverplate by a thin dielectric film. Plural PTC heater pellets are aligned on the heater plate and held by an insulating locator panel having cut-outs fixing the pellets on the heater plate. A second electrode, formed as a corrugated stainless steel spring plate covers and abuts the PTC pellets and is connected to the other side of the line. Next is a phenolic or ceramic insulator member with a recess for the corrugated spring plate to fit and abut therein. Alignment structure orients the heater plate, pellet locator panel, and phenolic insulator member with all the sandwich components of the entire sub-assembly fixed against horizontal or vertical movement permitting corrugated electrode flexing and good biasing of the pellets against the electrodes. A metallic mounting plate abutting the insulator member is provided for securing the heater sub-assembly in the housing.

4 Claims, 3 Drawing Figures

ELECTRICALLY HEATED HAIR STRAIGHTENER AND PTC HEATER ASSEMBLY THEREFOR

BACKGROUND OF THE INVENTION

Description of the Prior Art

Self-regulating positive temperature coefficient heating systems, known as PTC heaters, are well known and have been used for electric heating of various appliances. A PTC resistor, whether of ceramic or other material, is noteworthy in that it has low resistance at ambient temperature and then gradually increases in resistivity as it is heated by electric current through the resistor. The composition of the resistor determines the top temperature that the component is capable of, especially ceramic resistors, and the resistor displays a large sharp increase in resistance thus reducing the current to the resistor to a low level sufficient to maintain it at equilibrium temperature. PTC resistors can provide a large amount of heat while being self-regulating to avoid overheating and thus lend themselves well to appliance use. These PTC resistors commonly take the form of thin discs or pellets where their flat surfaces provide a large contact surface for good thermal contact and for the passage of electrical current through them so that all parts of the resistor material are heated simultaneously. It is necessary to provide good contact with the pellet surfaces for adequate use of the PTC resistors and various arrangements have been proposed both for the heaters per se as well as the use of the heaters in appliances.

Accordingly, it is the object of the present invention to provide a combination heated hair straightener using a specific form of PTC heater component sub-assembly to insure optimum heat transfer and heat distribution through the parts. Another object is to provide a PTC resistance heater assembly of a unique sandwich form that assures optimum heat transfer and heat distribution between the parts which assembly may be used in a variety of applications. Thus, the main object is to provide a PTC heater sub-assembly and such sub-assembly in a hair straightener appliance wherein the heater assembly uses a specific different sandwich construction of parts of provide optimum heat transfer and heat distribution between the parts.

SUMMARY OF THE INVENTION

Briefly described, there is provided a heated hair straightener including a handle for connecting to an electric source and a pair of pivoted scissors facing clamp housing on the handle with the handles having facing coverplate surfaces to abut and clamp hair therebetween. In this arrangement a PTC heater components sub-assembly is provided in one of the housings in a sandwich arrangement that includes the facing coverplate, a metallic heater plate forming a first electrode and insulated from the coverplate, an arrangement of PTC resistor heater means in the form of fixed pellets disposed on the heater plate and held in fixed position by an insulating locator panel. A second electrode is formed as a corrugated stainless springplate disposed over and abutting the pellets and connected to the other side of the electric source. An insulator partition member follows the corrugated springplate and contains it in a recess. Finally, there is provided means aligning the various parts and fastening them together to compress the pellets against the electrodes by the one corrugated electrode acting as a compression spring, all to positively locate the elements against horizontal and vertical movement and provide good heat distribution and optimum heat transfer for using the sub-assembly in numerous applications as in an appliance.

DESCRIPTION OF THE PREFERRED EMBODIMENT

Figure 1:
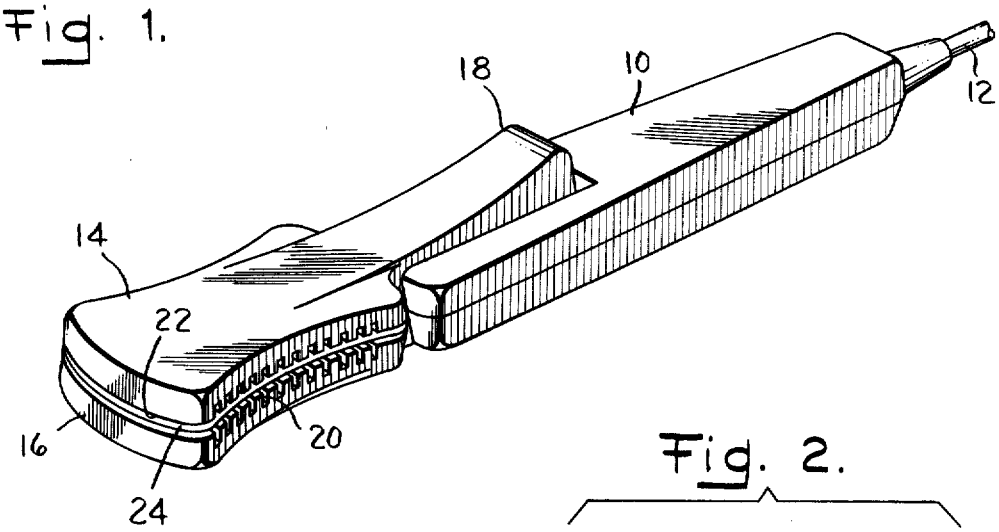
FIG. 1 is a perspective of a typical electric hair straightener appliance.

The invention is described and shown in connection with a PTC heater sub-assembly that may be used alone or may be usable in different applications and was designed for use in the hair straightener appliance shown in FIG. 1 herein and is so described.

Referring to FIG. 1, there is shown an appliance forming a heated hair straightener including plastic handle 10 that is connected by a conventional cord 12 to a suitable electric source with the handle enclosing the internal electrical connection and hinge structure, neither of which form part of the invention. Cooperating with the handle is a pair of facing upper 14 and lower 16 clamp housings that are suitably pivoted in handle 10 so that they operate in a scissors action with respect to the handle. Normally, lower housing 16 may be fixed and upper housing 14 is connected so that it opens by thumb pressure at 18 for receiving hair between the housing as straightened by comb mechanism 20. The appliance is operable as a hair straightener by closing clamp housings 14 and 16 on hair that is straightened by comb 20 and then pulling the device through the hair for straightening while applying heat to at least one of the cover plate surfaces 22, 24. The invention herein resides in the specific heater sub-assembly and as used in the appliance of FIG. 2.

It should be noted that the technology of the particular PTC heater arrangement to be described is generally known in many forms such as the internal construction described in U.S. Pat. No. 3,996,447 and a similar application of such PTC heaters in a hair curler as disclosed in U.S. Pat. No. 3,689,736 both dealing with different PTC construction. Actual PTC pellets having opposing terminal faces are commercially available and the instant invention is directed to a sandwich construction of generally known PTC pellets in a compact sub-assembly for application to uses such as an appliance.

Figure 2:
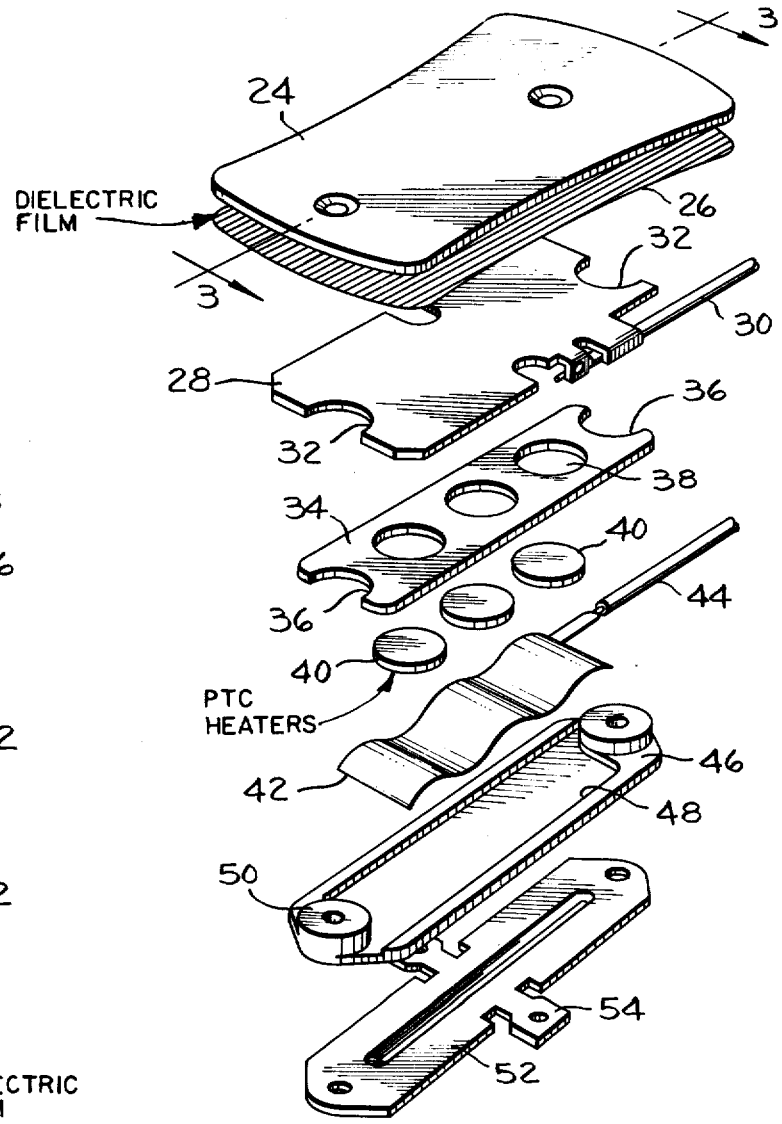
FIG. 2 is an exploded perspective of the PTC sub-assembly as used in the appliance.

Referring to FIG. 2 there is shown the breakdown of the heater component sub-assembly that is disposed, for example, in lower housing 16 to supply the necessary even heat to its coverplate 24. It could be placed in the upper housing 14 or be duplicated there although a single sub-assembly in one housing is sufficient. The sandwich construction includes the facing coverplate 24 of any suitable material but is preferably metallic such as aluminum for good heat distribution. Immediately adjacent to coverplate 24 is a thin dielectric film 26 of the same area as the coverplate. In order to supply heat to the coverplate, there is provided next a heater plate 28 which is a flat elongated plate covering a substantial portion (over half) of the coverplate and this heater plate forms a first electrode by connection with a suitable wire 30 that is connected to one side of the electrical source or line in handle 10. For a purpose to be explained, heater plate 28 has notches 32 at each end and the entire plate 28 abuts film 26 to insulate it from the coverplate as shown. The next item in the sandwich construction is an insulating mica locator panel 34 also with comparable notches 36 that match notches 32 in the heater plate. The locator panel is substantially coextensive with, meaning it generally covers, the heater plate although it is slightly narrower and is provided with circular cutouts 38, three being shown, the cutouts being provided to surround and locate PTC discs or pellets 40 so that the pellets do not move once they are aligned along the electrodes. As shown, three pellets are equally spaced along the heater plate for even heat distribution to the heater plate and hence the coverplate. Next to the pellets with their conventional opposing terminals there is provided a second electrode in the form of a preferably stainless steel corrugated springplate 42 having a wire 44 connecting it to the other side of the electric source or line. This corrugated electrode 42 completely covers and abuts the PIC pellets to provide a biasing spring force against the pellets and urge them against heater plate 28 for good contact and heat conductivity. Thus, the springplate serves as a compression spring and an electrode as well as the means for evening out the force biasing any number of PTC pellets.

Figure 3:
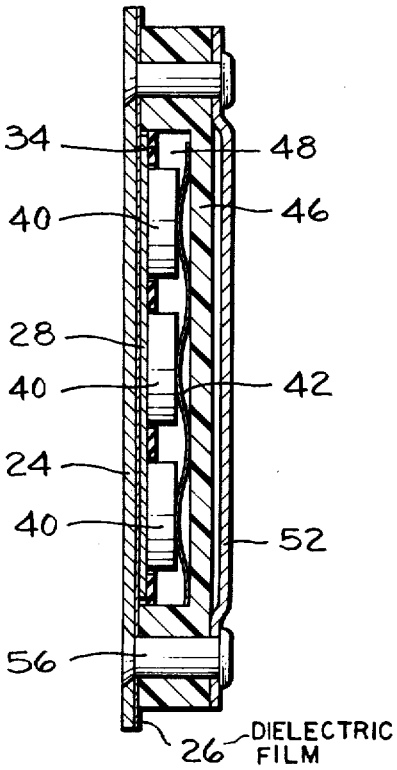
FIG. 3 is a cross-section on line 3—3 of FIG. 2 showing the parts in assembled position.

For holding the parts thus far described together, there is a final insulating member 46 in the form of an elongated partition that is also substantially coextensive with the electrodes 28 and 42 and is generally a suitable phenolic or ceramic and is provided with recess 48 to contain and nest springplate 42 to limit horizontal movement. The partition 46 is also molded with buttons 50 that fit with notches 32 and 36 for cooperatively aligning the various parts when the sandwich is drawn together as shown in FIG. 3. Thus, locator panel 34 and the alignment means of button 50 and notches 32 and 36 holds the entire sub-assembly fixed against any horizontal and vertical movement while permitting flexing of corrugated electrode 42.

For holding the entire sub-assembly together, as described, the parts may be suitably connected directly to the lower housing 16 or, conveniently, a mounting plate 52 is provided to complete the sandwich. The mounting plate has simple means such as ears 54 through which screws can attach the entire sub-assembly to housing 16. Also, as shown in FIG. 3, fastening means such as rivets 56 extend through the entire sub-assembly from mounting plate 52 to coverplate 24 to hold the sub-assembly together.

The entire sub-assembly is pulled together to be held in a compact sandwich construction as shown in FIG. 3, providing a desirable minimum thermal distance from the PTC pellets 40 to the outside surface 24 of the coverplate. The spacing and alignment of the pellets with the biasing action by the corrugated electrode 42 provides even distribution over the entire coverplate surface 24 and the various dielectric layers between all electrical connections and coverplate 24 prevents any possible shock by contact with the metallic coverplate. The corrugated electrode 42 functions as a compression spring and as an electrical reliable pressure contact on the top surfaces of the pellets 40 thus functioning as a dual component of spring and electrode. Also, the large area interface between heater plate 28, dielectric film 26, and coverplate surface 24 assures that optimum heat transfer and heat distribution is obtained through the dielectric film 26. Finally, partition 46 provides positive location for the heater plate 28 and locator panel 34 by its aligning means and thus serves to insulate any hot metal parts from the thermoplastic housing of the appliance. This provides for minimum temperatures of any metallic parts in contact with the appliance housing. The compact sub-assembly therefore provides a thin assembly applicable to numerous applications, is of simple inexpensive construction and minimum parts, both obtainable by the use of the corrugated springplate acting as a spring and an electrode, to bias the parts into a tight sub-assembly.

While I have hereinbefore described a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. A heated hair straightener including a handle having power supply means for connection to an electric source, a pair of facing clamp housings pivoted on said handle for a cooperative scissors action therebetween, the housings each having a coverplate facing the coverplate of the other housing for abutment and clamping of hair therebetween and a heater component subassembly in at least one housing for heating the coverplate thereof, said heater component subassembly comprising a sandwich arrangement of the coverplate of said housing, a metallic heater plate forming a first electrode connected to one side of said power supply means, said heater plate overlying said coverplate and comprising a flat elongated plate covering a substantial portion of said coverplate, a thin dielectric film between said heater plate and said coverplate for insulating said heater plate therefrom, PTC heater means comprising multiple spaced pellets each having opposed terminal means and aligned on said heater plate with one of the terminal means of each pellet in electrical contact therewith, a second electrode formed as a corrugated spring plate having one side covering and electrically contacting the other terminal means of each pellet, said spring plate being connected to the other side of said power supply means, an electrically insulating locator panel substantially coextensive with said heater plate and provided with cutouts surrounding and locating said pellets between said heater plate and spring plate, an electrical insulator member abutting the other side of said spring plate, means aligning said PTC heater means, electrodes, and member in fixed assembled relation to one another, and means fastening together the parts comprising said heater component subassembly with said electrodes compressed against the terminal means of said pellets, and means adjacent said member securing said heater component subassembly in said housing.

2. Apparatus as described in claim 1 wherein said insulator member is an elongated partition substantially coextensive with said heater plate and corrugated spring plate and wherein said means for securing said heater component subassembly in said housing includes a separate coextensive mounting plate disposed against the side of said partition opposite said spring plate, said mounting plate having means for securing it to the rest of the sandwich subassembly and to said clamp housing.

3. A PTC resistance heater assembly comprising a sandwich arrangement of a coverplate, a flat elongated first electrode heater plate covering a substantial portion of one side of said coverplate, said heater plate having means for connecting the heater plate to a source of electric power, a thin dielectric film coextensive with said coverplate between it and said heater plate, multiple PTC heater pellets each having opposed terminal means, said heater pellets being spaced along said heater plate with one of said terminal means of each pellet in electrical contact therewith, an electrically insulating locator panel substantially coextensive with said heater plate and having cutouts surrounding and locating said pellets, a corrugated second electrode spring plate, said spring plate having means for connecting the spring plate to a source of electric power, said spring plate abutting said pellets to bias them against said heater plate and electrically contacting the other terminal means of each pellet, an electrically insulating partition with a recess therein covering and nesting said corrugated spring plate electrode, and a mounting plate coextensive with and covering said partition and having means fastening together said coverplate, insulating partition, and mounting plate together with said heater plate and spring plate compressed against the terminal means of said pellets.

4. Apparatus as described in claim 3 wherein said coverplate is an aluminum plate, said locator panel is a mica panel and said insulating partition is a phenolic or ceramic, and each of said heater plate, panel, and partition having cooperating aligning means, whereby the sandwich components of the entire heater assembly are all fixed against horizontal and vertical movement while permitting flexing of said corrugated electrode spring plate to act as a compression spring for electrical pressure contact against said pellets.

* * * * *